US005690790A

United States Patent [19]

Headlam et al.

[11] Patent Number: 5,690,790

[45] Date of Patent: Nov. 25, 1997

[54] TEMPORARY WET STRENGTH PAPER

[75] Inventors: Michael Martyn Headlam, Cincinnati; David Jay Smith, Montgomery, both of Ohio

[73] Assignee: The Procter & Gamble Company, Cincinnati, Ohio

[21] Appl. No.: 624,765

[22] Filed: Mar. 28, 1996

[51] Int. Cl.[6] ..... D21H 17/24; D21H 17/31; D21H 17/45

[52] U.S. Cl. ..... 162/175; 162/183; 162/164.7; 162/170

[58] Field of Search ..... 162/175, 164.6, 162/164.7, 168.2, 168.3, 178, 184, 183, 166, 111, 112, 158, 164.1, 168.1

[56] References Cited

U.S. PATENT DOCUMENTS

| | | | |
|---|---|---|---|
| 2,685,508 | 8/1954 | Spear | 162/166 |
| 3,084,057 | 4/1963 | Jordan | 106/205 |
| 3,138,473 | 6/1964 | Floyd et al. | 106/205 |
| 3,205,125 | 9/1965 | Opie et al. | 162/178 |
| 3,225,028 | 12/1965 | Nordgren | 260/209 |
| 3,236,832 | 2/1966 | Opie et al. | 536/114 |
| 3,239,500 | 3/1966 | Keen et al. | 260/209 |
| 3,297,604 | 1/1967 | Germino | 260/17.4 |
| 3,410,828 | 11/1968 | Kekish | 525/326.9 |
| 3,683,917 | 8/1972 | Comeford | 128/287 |
| 3,691,153 | 9/1972 | Vemuri | 260/209 |
| 4,129,722 | 12/1978 | Iovine et al. | 536/43 |
| 4,269,975 | 5/1981 | Rutenberg et al. | 536/114 |
| 4,557,801 | 12/1985 | Avis | 162/157 |
| 4,605,702 | 8/1986 | Guerro et al. | 525/154 |
| 4,675,394 | 6/1987 | Solarek et al. | 536/43 |
| 4,683,298 | 7/1987 | Yalpani | 536/45 |
| 4,959,466 | 9/1990 | White | 536/119 |
| 4,981,557 | 1/1991 | Bjorkquist | 162/168.2 |
| 5,338,406 | 8/1994 | Smith | 162/168.2 |
| 5,338,407 | 8/1994 | Dasgupta | 162/168.3 |
| 5,397,435 | 3/1995 | Ostendorf et al. | 162/112 |
| 5,405,501 | 4/1995 | Phan et al. | 162/127 |

FOREIGN PATENT DOCUMENTS

| | | | |
|---|---|---|---|
| 928591 | 6/1963 | United Kingdom . | |
| 939389 | 10/1963 | United Kingdom | 536/123 |
| 1056711 | 1/1967 | United Kingdom . | |
| 1554002 | 10/1979 | United Kingdom | A41B 13/02 |

OTHER PUBLICATIONS

Borchert et al., "Cationic Dispersions of Dialdehyde Starch. Theory and Preparation", Tappi, vol. 47, No. 9, pp. 525–528, Sep. 1964.

Haug, "Guar Mannogalactan Studies", Tappi, vol. 36, No. 1, pp. 53–64, Jan. 1953.

Swanson, "Conversion of Mannogalactan Mucilages in Aqueous Borax Solutions for Use as Tubsizing and Coating Adhesives", *TAPPI*, vol. 33, No. 2, pp. 77–81, (1950).

Haug, "Purification and Characterization of Purified Fraction", *TAPPI*, vol. 36, No. 1, pp. 47–51 (1953).

Haug, "Guar Mannogalactan Studies. II. Effect of Certain Variables, Including Borax, on the Rate of Oxidation of the Purified Mucilage", *TAPPI*, vol. 36, No. , pp. 53–58 (1953).

Opie, "Dialdehyde Galactomannan Gums as Wet End Wet and Dry Strength Additives", *TAPPI*, vol. 47, No. 8, pp. 504–507 (1964).

Yiannos, "Gums—Vegetable", 8–7, *Handbook of Pulp and Paper Technology*, (2nd Ed., Britt, Van Nostrand Reinhold Co.), pp. 650–654, (1964).

Browning, "Wood Chemistry", 1–1, *Handbook of Pulp and Paper Technology*, (2nd Ed., Britt, Van Nostrand Reinhold Co.), pp. 3–12, (1964).

Hui et al., "Some Properties of Galactomannans", *TAPPI*, vol. 47, No. 1, pp. 39–42, (1964).

U.S. application No. 08/623,309, Smith et al., filed Mar. 28, 1996.

U.S. application No. 08/623,293, Smith, filed Mar. 28, 1996.

*Primary Examiner*—Donald E. Czaja
*Assistant Examiner*—Jose A. Fortuna
*Attorney, Agent, or Firm*—Loretta J. Henderson; Carl J. Roof; E. Kelly Linman

[57] ABSTRACT

The present invention relates to paper products having temporary wet strength. The paper products contain cellulosic fibers that are treated with a polyaldehyde polymer having free aldehyde groups and a water soluble polyhydroxy polymer. The initial wet strength obtained with the combined use of these materials is significantly greater than that obtained by use of either the polyaldehyde or pelyhydroxy polymer alone. At the same time, the wet strength decays at a rate that is rapid enough to enable the paper product to be flushed under conditions of normal use.

15 Claims, No Drawings

TEMPORARY WET STRENGTH PAPER

FIELD OF THE INVENTION

The invention relates to paper products having temporary wet strength. The invention especially relates to paper products comprising a polyaldehyde polymer and a polyhydroxy polymer to provide paper products having both initial wet strength and an acceptable rate of wet strength decay.

BACKGROUND OF THE INVENTION

Paper webs or sheets, sometimes called tissue or paper tissue webs or sheets, find extensive use in modern society. These include such staple items as paper towels, facial tissues and sanitary (or toilet) tissues. These paper products can have various desirable properties, including wet and dry tensile strength.

The dry strength of paper products should be sufficient to enable manufacture of the product and use of the product in the relatively dry condition. Increases in dry tensile strength can be achieved either by mechanical processes to insure adequate formation of hydrogen bonding between the hydroxyl groups of adjacent paper making fibers, or by the inclusion of certain dry strength additives. In this regard, one type of dry strength additives are the galactomannan gums, e.g., guar gum and locust bean gum. The galactomannan gums and their use in paper are described in more detail in *Handbook of Pulp and Paper Technology*, 2nd Ed., Britt, pp. 650–654 (Van Nostrand Reinhold Co. 1964), incorporated herein by reference. The galactomannan gums generally impart dry strength to paper products. Unfortunately, in addition to having dry strength, the paper products incorporating such gums tend to be harsh to the hand. Therefore, the galactomannan gums have found utility in printing and writing paper but generally have not been useful in paper products where softness is a desirable characteristic, such as toilet tissue and facial tissue.

Wet strength is a desirable attribute of many disposable paper products that come into contact with aqueous fluids in use, such as napkins, paper towels, household tissues, disposable hospital wear, etc. In particular, it is often desirable that such paper products have sufficient wet strength to enable their use in the moistened or wet condition. For example, moistened tissue or tower may be used for body or other cleaning. Unfortunately, an untreated cellulose fiber assemblage will typically lose 95% to 97% of its strength when saturated with water such that it cannot usually be used in the moistened or wet condition.

Historically, one approach to providing wet strength to paper products is to incorporate additives in the paper product which contribute toward the formation of interfiber bonds which are not broken or, for temporary wet strength, which resist being broken, by water. A water soluble wet strength resin may be added to the pulp, generally before the paper product is formed (wet-end addition). The resin generally contains cationic functionalities so that it can be easily retained by the cellulose fibers, which are naturally anionic.

A number of resins have been used or disclosed as being particularly useful for providing wet strength to paper products. Certain of these wet strength additives have resulted in paper products with permanent wet strength, i.e., paper which when placed in an aqueous medium retains a substantial portion of its initial wet strength over time. Exemplary resins of this type include urea-formaldehyde resins, melamine-formaldehyde resins and polyamide-epichlorohydrin resins. Such resins have limited wet strength decay.

Permanent wet strength in paper products is often an unnecessary and undesirable property. Paper products such as toilet tissues, etc., are generally disposed of after brief periods of use into septic systems and the like. Clogging of these systems can result if the paper product permanently retains its hydrolysis-resistant strength properties. Therefore, manufacturers have more recently added temporary wet strength additives to paper products for which wet strength is sufficient for the intended use, but which then decays upon soaking in water. Decay of the wet strength facilitates flow of the paper product through septic systems. Numerous approaches for providing paper products claimed as having good initial wet strength which decays significantly over time have been suggested.

One type of temporary wet strength additive are aldehyde containing resins exemplified by COBOND 1000, an aldehyde functionalized cationic starch commercially available from the National Starch & Chemical Corp. of Bloomfield, N.J. and PAREZ 631 NC and PAREZ 750A, aldehyde functionalized cationic polyacrylamides commercially available from Cytec Industries, Inc. of West Paterson, N.J.

It has now surprisingly been found that the combined use in paper products of a polyaldehyde polymer and a water soluble polyhydroxy polymer, especially polysaccharides containing cis-hydroxyl groups, provide an initial temporary wet strength that is significantly greater than that obtained by use of either the polyaldehyde polymer or the polyhydroxy polymer alone. The paper products of this invention may have a wet tensile decay rate that is sufficiently rapid to enable the product to be flushed under normal conditions of use, e.g., a 30 minute wet tensile strength of less than about 40 g/inch.

It is an object of this invention to provide paper products, and particularly paper tissue products, that have an initial wet strength sufficient for use of the paper product in the moistened condition, but which also exhibit wet strength decay (i.e., temporary wet strength), preferably such that very low strength levels are attained subsequent to the period of intended use. Another object of the present invention is to provide paper products having a combination of an initial wet strength sufficient for use of the paper product for body cleaning in the moistened condition, and a rate of wet strength decay sufficient for a flushable product. It is a further object of the present invention to provide tissue paper products having an initial total wet tensile strength of at least about 80 g/inch, preferably at least about 120 g/inch. Yet another object of this invention is to provide tissue paper products having, in addition to these initial total wet strengths, a 30 minute total wet tensile strength of not more than about 40 g/inch.

SUMMARY OF THE INVENTION

The present invention relates to paper products having an initial wet strength sufficient for use of the paper product in the moistened condition, yet which is also temporary. The paper products contain cellulosic fibers that are treated with a polyaldehyde polymer having free aldehyde groups and a water soluble polyhydroxy polymer, especially polysaccharides having cis-hydroxyl groups in at least a portion of the main polymeric chain (i.e., polymer backbone). The polymers form bonds joining the fibers (interfiber bonds are formed) when the paper product is dried. The initial wet strength obtained with the combined use of these materials is surprisingly significantly greater than that obtained by use of either the polyaldehyde or polyhydroxy polymer alone. Surprisingly, the wet strength of preferred paper products decays at a rate that is rapid enough to enable the paper product to be flushed under conditions of normal use.

Preferred polyaldehyde polymers are cationic. For example, the polyaldehyde may be a cationic, aldehyde functionalized starch or a cationic, aldehyde functionalized polyacrylamide.

Preferred polysaccharides include those derived from one or more of the sugars mannose, galactose, allose, altrose, gulose, talose, ribose, and lyxose. Economically preferred polysaccharides are guar gum, locust bean gum and ionic derivatives thereof. The polysaccharide is preferably a neutral polysaccharide or a charge balanced mixture of polysaccharides.

DETAILED DESCRIPTION OF PREFERRED EMBODIMENT(S)

As used herein, the terms "paper" and "paper products" include sheet-like masses and molded products containing cellulosic fibers. Cellulosic fibers of diverse natural origin are applicable to the invention. Digested fibers from softwood (derived from coniferous trees), hardwood (derived from deciduous trees) or cotton linters are preferably utilized. Fibers from Esparto grass, bagasse, kemp, flax, and other lignaceous and cellulosic fiber sources may also be utilized as raw material in the invention. The optimum cellulosic fiber source utilized in conjunction with this invention will depend upon the particular end use contemplated. Generally wood pulps will be utilized. Applicable wood pulps include chemical pulps, such as Kraft (i.e., sulfate) and sulfite pulps as well as mechanical pulps including, for example, groundwood, thermomechanical pulp (i.e., TMP) and chemi-thermomechanical pulp (i.e., CTMP). Chemical pulps, however, are preferred since they impart a superior tactile sense of softness to tissue sheets made therefrom. Completely bleached, partially bleached and unbleached fibers are applicable. It may frequently be desired to utilize bleached pulp for its superior brightness and consumer appeal. For products such as paper tissue, paper towels and absorbent pads for diapers, sanitary napkins, catamenials, and other similar absorbent paper products, it is especially preferred to utilize fibers from northern softwood pulp due to its premium strength characteristics.

Also useful in the present invention are fibers derived from recycled paper, which can contain any or all of the above categories as well as other non-fibrous materials such as fillers and adhesives used to facilitate the original paper making.

The paper products may also contain non-cellulosic fibrous polymeric material characterized by having hydroxyl groups attached to the polymer backbone, for example glass fibers and synthetic fibers modified with hydroxyl groups. Other fibrous material, e.g., synthetic fibers, such as rayon, polyethylene and polypropylene fibers, can also be utilized in combination with natural cellulosic fibers or other fibers containing hydroxyl groups. Mixtures of any of the foregoing fibers may be used. Since the strength of the paper product tends to increase with the number of hydroxyl groups in the fibers, it will usually be preferred to employ primarily, more preferably wholly, fibers having hydroxyl groups. Cellulosic fibers are economically preferred.

The paper products also contain a polyaldehyde polymer having free aldehyde groups. By "free aldehyde groups" it is meant that the aldehyde groups are not bonded to other functional groups which would render them unreactive with the cellulosic fibers. For example, an aldehyde group may form interfiber chemical bonds, typically covalent bonds, with a cellulosic hydroxyl group when the paper product is dried (chemical bonds joining different cellulosic fibers are formed). Preferred polyaldehydes are those which impart a temporary, rather than permanent, wet strength to paper products when they are incorporated as a sole strength additive in comparable paper products.

Preferred polyaldehydes are water soluble in order to facilitate a water based process. As used herein, "water soluble" includes the ability of a material to be dissolved, dispersed, swollen, hydrated or similarly admixed in water. Similarly, as used herein, reference to the phrase "substantially dissolved," "substantially dissolving" and the like refers to the dissolution, dispersion, swelling, hydration and the like admixture of a material in a liquid medium (e.g., water). The mixture typically forms a generally uniform liquid mixture having, to the naked eye, one physical phase.

Suitable polyaldehyde polymers include natural and synthetic polymers prepared or modified to contain aldehyde groups. Suitable polyaldehyde polymers include, but are not limited to, aldehyde modified starches and polyacrylamides, and acrolein copolymers.

The polyaldehyde polymer may be electronically neutral or charged, e.g., an ionic polymer such as anionic or cationic polyaldehyde polymers. Cationic polyaldehyde polymers are preferred. Without intending to be limited or bound by theory, it is believed that the cationic polyaldehyde tends to be retained on the cellulosic fibers, which are anionic in nature. Exemplary cationic polyaldehyde polymers include cationic, aldehyde functionalized starches and cationic, aldehyde functionalized polyacrylamides, the polyacrylamides being preferred. Cationic, aldehyde-functionalized starches suitable for use herein include that which is commercially available from National Starch & Chemical Co. of Bloomfield, N.J. under the trademark COBOND 1000. Cationic, aldehyde-functionalized polyacrylamides suitable for use herein include those commercially available from Cytec Industries Inc. of West Patterson, N.J. under the trademark PAREZ 631 NC and PAREZ 750A, PAREZ 750A being currently preferred.

Aldehyde-functionalized polymers suitable for use herein also include other temporary wet strength resins available from Cytec Industries under the trademark PAREZ, including PAREZ 750B, and those temporary wet strength resins described in U.S. Pat. No. 4,954,538, Dauplaise et al., issued September 1990; U.S. Pat. No. 4,981,557, Bjorkquist, issued Jan. 1, 1991; and U.S. Pat. No. 5,320,711, Dauplaise et al., issued Jun. 14, 1994; each incorporated herein by reference.

The paper products also contain a water-soluble polyhydroxy polymer. Suitable polyhydroxy polymers are those having hydroxyl groups that are capable of reacting with aldehyde groups of the polyaldehyde to form chemical bonds, typically covalent bonds. For example, the hydroxyl group and aldehyde group may react to form acetal or hemiacetal bonds. Polyhydroxy polymers that are suitable for use herein include water-soluble polysaccharides and polyvinyl alcohol. In a preferred embodiment, the polyhydroxy polymer is a polysaccharide in which the hydroxyl groups of at least a portion of the polymer repeating units are cis-hydroxyl groups. While other polyhydroxy polymers, e.g., other water-soluble polysaccharides and polyvinyl alcohol, provide good levels of initial and temporary wet strength when combined with the polyaldehyde polymer, polysaccharides containing cis-hydroxyl groups provide an unexpectedly especially high level of temporary wet strength. Without intending to be limited or otherwise bound by theory, it is believed that the cis-hydroxyl groups may impart neighboring group participation that facilitates covalent bond formation with the polyaldehyde. Additionally or alternatively, the cis-hydroxyl groups may form a relatively strong bond via hydrogen bonding to the cellulosic fibers such that there is enhanced retention of the polysaccharide to the fibers.

Suitable polysaccharides having the cis-hydroxyl groups include those derived from one or more sugars selected from the group consisting of mannose, galaetose, allose, altrose, gulose, talose, ribose, and lyxose. Economically preferred polysaccharides of this type are derived from mannose, galactose or both. Thus, economically preferred polysaccharides include galactomannan gums, e.g., guar gum and locust bean gum. Mixtures of polysaccharides may be used.

The polysaccharide may contain sugars other than those specifically mentioned. The sugar content of the polysaccharide can be determined by hydrolysis of the polysaccharide to the constituent sugars by known methods with subsequent qualitative and quantitative analysis of the hydrolyzate by separation techniques such as paper, thin layer, or gas liquid chromatography.

The polysaccharides may be neutral or may possess an electronic charge, e.g., an ionic charge. Thus, anionic and cationic polysaccharides are suitable for use herein. However, the polymer should be selected such that it will not result in excessive electrostatic repulsion between the fibers and the polymer. Preferably, the polysaccharide or mixture of polysaccarides is electronically neutral. Thus, each of the polysaccharides used in the invention may be neutral. Alternatively, a charge balanced mixture of polysaccharides may be used. By "charge balanced mixture" of polysaccharides, it is meant that the total amounts of each of the electronically charged polysaccharides in a polysaccharide mixture are selected such that the mixture is essentially neutral. A neutral polysaccharide or a charge balanced mixture of polysaccharides may provide a higher initial wet strength than an electronically charged polysaccharide or polysaccharide mixture. For example, in a passive drainage environment such as encountered in the preparation of handsheets, a combination of cationic or anionic polysaccharide with the polyaldehyde polymer tends to provide less initial wet strength than a comparable combination of a neutral polysaccharide or charge balanced polysaccharide mixture with the polyaldehyde polymer. In a turbulent drainage environment such as encountered on commercial paper making equipment, a charge balanced mixture of polysaccharides tends to provide the highest initial wet strengths. Without intending to be bound by theory, it is believed that the charged polysaccharide more readily and/or strongly bonds to the fibers and the polyaldehyde polymer to thereby provide higher initial wet strengths relative to a neutral, cationic or anionic polysaccharide. As will be appreciated by the artisan having ordinary skill, various intermediate combinations of neutral and charged polysaccharides may provide intermediate levels of initial wet strength.

The initial wet tensile strength tends to increase with the molecular weight of the polysaccharide. Therefore, for high initial wet strength, it is generally preferred to use polysaccharides having a relatively high molecular weight. Electronically charged polysaccharides tend to have lower molecular weights than the corresponding neutral polysaccharide from which they are produced, such that the neutral polysaccharides may provide higher initial wet tensile strengths, if each polymer has comparable retention, especially in a passive drainage environment such as handsheet formation.

Polysaccharides that are suitable for use herein are commercially available from Aqualon, a division of Hercules Incorporated of Wilmington, Del., under the trade names GALACTOSOL and SUPERCOL (both neutral guar gums), and the anionic, cationic, and amphoteric guar gums derived from them. Neutral and charged guar gums are also commercially available from other manufacturers.

The polyaldehyde polymer and the polyhydroxy polymer are combined with the cellulosic fibers in a manner which allows the polymers to form a bonded fiber mass, generally in the form of a sheet containing the fibers. The bonded fiber mass has a dry strength and an initial wet strength that is higher than a comparable fiber mass with only one or neither of these additives.

In forming paper generally in the form of sheets, the polymers are preferably combined with the cellulosic fibers in the wet-end of a wet laid paper-making process such as are known in the art. Wet laid paper making processes typically include the steps of providing a slurry containing the cellulosic fibers (the slurry is alternatively referred to herein as a paper making furnish), depositing the slurry of fibers on a substrate such as a foraminous forming wire (e.g., a Fourdrinier wire), and setting the fibers into a sheeted form while the fibers are in a substantially unflocculated condition. The step of setting the fibers into sheeted form may be performed by allowing the fluid to drain and pressing the fibers against the foraminous wire (dewatering), for example, with a screened roll, such as a cylindrical Dandy Roll. Once set, the fibrous sheet may then be dried and optionally compacted as desired.

Thus, in a wet-laid paper making process, the polymers are preferably combined with the cellulosic fibers by adding the polymers to the paper making furnish, generally an aqueous paper making furnish comprising water and the cellulosic fibers. In a preferred embodiment, the polymers are added to the furnish after substantially dissolving the individual polymers in a separate suitable mediums. Where the polymer is hydrated by the medium, for example, in the case of guar gum, it is preferred to bring the polymer to its equilibrium swell. In an alternative embodiment, the polymers may be added to the furnish after substantially dissolving both of the polymers in a single suitable medium. In either case, the medium is capable of substantially dissolving the polymer(s) and is preferably an aqueous medium and most preferably water. In yet another alternative embodiment, the polymers are added directly to the furnish. The furnish is adjusted, if necessary, to a pH of about 7 or less, preferably from about 4 to about 7.

The polyaldehyde and the polyhydroxy polymer must remain in contact with the cellulosic fibers, prior to setting the fibers, for a period sufficient to allow adsorption of the polymers by the fibers and bonding between the polyaldehyde, polyhydroxy polymer and the cellulosic fibers. Otherwise the polyaldehyde and/or polyhydroxy polymer may be lost during the setting step such that the wet strength improvements are not obtained. A sufficient period is typically achieved by leaving the polyaldehyde and the polyhydroxy polymer, individually or in combination, in contact with the cellulosic fibers for a period of from a few seconds to about 60 minutes prior to setting the fibers, more typically on the order of a few seconds. Bonding may involve ionic bonding and/or covalent bonding.

The temperature of the furnish will generally be between greater than 0° C. and less than 100° C. and is more typically at about room temperature (20–25° C.). The paper making process is generally conducted in air at atmospheric pressure, although other environments and pressures may be used.

In a particularly preferred embodiment, the polyaldehyde is added to the furnish before the polyhydroxy polymer. Paper products prepared according to this embodiment tend to have higher initial wet strengths compared to paper products first treated with the polyhydroxy polymer or a mixture of the polyaldehyde and the polyhydroxy polymer. The pH of the furnish containing the polyaldehyde and the fibers is preferably adjusted to a pH of about 7 or less, more preferably from about 4 to about 7. The polyaldehyde remains in contact with the cellulosic fibers for a period sufficient to allow chemical bonding between the polyaldehyde and cellulosic fibers. A period of from a few seconds to about 60 minutes is typically sufficient, more typically a few seconds.

According to this embodiment, the water soluble polyhydroxy polymer is then added to the paper making furnish. The pH of the furnish is preferably adjusted to a pH of about 7 or less, more preferably from about 4 to about 7. The polyhydroxy polymer remains in contact with the cellulosic fibers and the polyaldehyde for a period sufficient to allow chemical bonding between the cellulosic fibers, polyaldehyde and polyhydroxy polymer. A period of from a few seconds to about 60 minutes is typically sufficient, more typically a few seconds.

The furnish may also include conventional paper-making additives such as are known in the art. For example, paper softeners, such as tetra-alkylammonium compounds, may be included in the furnish.

Once the furnish is prepared, it is converted into final web or sheet form by any suitable wet laying method, including a method previously described as involving deposition of the furnish, setting of the fibers, drying and optionally compacting.

The amount of polyaldehyde polymer and polyhydroxy polymer that are combined with the cellulosic fibers is generally selected to provide a balance of initial wet strength, wet tensile decay and optionally other properties, including dry strength, consistent with the objects of the invention. In general, with increasing amounts of the polyaldehyde polymer there is an increase in dry strength, initial wet tensile strength, and wet strength decay rate (particularly in wet strength decay rate). An increase in the amount of polyhydroxy polymer tends to result in an increase in dry strength and initial wet strength (particularly in dry strength) and a decrease in softness. The paper products will typically contain from about 0.01 to about 1 weight % of the polyaldehyde polymer and from about 0.01 to about 5 weight % of the polyhydroxy polymer, based on the weight of the cellulosic fibers and optionally other fibers containing hydroxyl groups. Preferably, the paper products will contain from about 0.01 to about 0.5 weight % of the polyaldehyde polymer and from about 0.01 to about 3 weight % of the polyhydroxy polymer, based on the weight of the cellulosic fibers and optionally other fibers containing hydroxyl groups. For example, a suitable paper product contains about 0.5 weight % of the polyaldehyde polymer and from about 2 weight % of the polyhydroxy polymer.

Without intending to be bound or otherwise limited by theory, it is believed that a port/on of the free aldehyde groups of the polyaldehyde bond to the cellulosic fibers by formation of hemiacetal groups through reaction of at least a portion of the cellulosic hydroxyl groups and at least a portion of the aldehyde groups as the paper product dries. Other free aldehyde groups of the polyaldehyde react with at least a portion of the hydroxyl groups of the polyhydroxy polymer to form hemiacetal groups as the paper product dries. It is believed that the polyhydroxy polymer extends the bonding of the polyaldehyde by providing more bonding sites and by bridging the distance between fibers. The resultant network tends to have a relatively high initial wet tensile strength. The hemiacetal linkages are reversible in water, slowly reverting to the original polyaldehyde and polyhydroxy materials. This reversibility confers temporary wet strength to the paper product.

The present invention is particularly adapted for paper products which are to be disposed into sewer systems, such as toilet tissue. However, it is to be understood that the present invention is applicable to a variety of paper products including, but not limited to disposable absorbent paper products such as those used for household, body, or other cleaning applications and those used for the absorption of body fluids such as urine and menses. Exemplary paper products thus include tissue paper including toilet tissue and facial tissue, paper towels, absorbent materials for diapers, feminine hygiene articles including sanitary napkins, pantiliners and tampons, adult incontinent articles and the like, and writing paper.

Tissue paper of the present invention can be homogeneous or multi-layered construction; and tissue paper products made therefrom can be of a single-ply or multi-ply construction. The tissue paper preferably has a basis weight of between about 10 g/m$^2$ and about 65 g/m$^2$, and density of about 0.6 g/cm$^3$ or less. More preferably, the basis weight will be about 40 g/m$^2$ or less and the density will be about 0.3 g/cm$^3$ or less. Most preferably, the density will be between about 0.04 g/cm$^3$ and about 0.2 g/cm$^3$. See Column 13, lines 61–67, of U.S. Pat. No. 5,059,282 (Ampulski et al), issued Oct. 22, 1991, which describes how the density of tissue paper is measured. (Unless otherwise specified, all amounts and weights relative to the paper are on a dry basis.) The tissue paper may be conventionally pressed tissue paper, pattern densified tissue paper, and uncompacted, nonpattern-densified tissue paper. These types of tissue paper and methods for making such paper are well known in the art and are described, for example, in U.S. Pat. No. 5,334,286, issued on Aug. 2, 1994 in the names of Dean V. Phan and Paul D. Trokhan, incorporated herein by reference in its entirety.

EXPERIMENTAL

Strength Tests

The paper products are aged prior to tensile testing a minimum of 24 hours in a conditioned room where the temperature is 73° F. ±4° F.(22.8° C.±2.2° C.) and the relative humidity is 50%±10%.

1. Total Dry Tensile Strength ("TDT")

This test is performed on one inch by five inch (about 2.5 cm×12.7 cm) strips of paper (including handsheets as described below, as well as other paper sheets) in a conditioned room where the temperature is 73° F.±4° F.(about 28° C.±2.2° C.) and the relative humidity is 50%±10%. An electronic tensile tester (Model 1122, Instron Corp., Canton, Mass.) is used and operated at a crosshead speed of 2.0 inches per minute (about 5.1 cm per min.) and a gauge length of 4.0 inches (about 10.2 cm). Reference to a machine direction means that the sample being tested is prepared such that the 5" dimension corresponds to that direction. Thus, for a machine direction (MD) TDT, the strips are cut such that the 5" dimension is parallel to the machine direction of manufacture of the paper product. For a cross machine direction (CD) TDT, the strips are cut such that the 5" dimension is parallel to the cross-machine direction of manufacture of the paper product. Machine-direction and cross-machine directions of manufacture are well known terms in the art of paper-making.

The MD and CD tensile strengths are determined using the above equipment and calculations in the conventional manner. The reported value is the arithmetic average of at least six strips tested for each directional strength. The TDT is the arithmetic total of the MD and CD tensile strengths.

2. Wet Tensile

An electronic tensile tester (Model 1122, Instron Corp.) is used and operated at a crosshead speed of 1.0 inch (about 2.5 cm) per minute and a gauge length of 1.0 inch (about 2.5 cm), using the same size strips as for TDT. The two ends of the strip are placed in the upper jaws of the machine, and the center of the strip is placed around a stainless steel peg. The strip is soaked in distilled water at about 20° C. for the desired soak time, and then measured for tensile strength. One half the measured wet tensile is taken as the single strip wet strength. As in the case of the TDT, reference to a machine direction means that the sample being tested is prepared such that the 5 " dimension corresponds to that direction.

The MD and CD wet tensile strengths are determined using the above equipment and calculations in the conventional manner. The reported value is the arithmetic average of at least six strips tested for each directional strength. The total wet tensile strength for a given soak time is the arithmetic total of the MD and CD tensile strengths for that soak time. Initial total wet tensile strength (ITWT) is measured when the paper has been saturated for 5±0.5 seconds. 30 minute total wet tensile (30 MTWT) is measured when the paper has been saturated for 30±0.5 minutes.

EXAMPLES

The following nonlimiting examples are provided to illustrate the preparation of paper sheets that are treated with a polyaldehyde polymer containing free aldehyde groups and a water swellable polyhydroxy polymer in accordance with the invention. The scope of the invention is to be determined by the claims which follow.

The following abbreviations are used in the examples:

EHK—Eucalyptus Hardwood Kraft (short paper making fibers)

NSK—Northern Softwood Kraft (long paper making fibers)

CTMP—Chemi-thermomechanical Pulp (short fibers)

NGG—GALACTOSOL 20H5F1 (neutral guar gum, e.g., Hercules Inc., Wilmington, Del.)

AGG—anionic guar gum, e.g., Hercules Inc., Wilmington, Del.

CGG—cationic guar gum, e.g., Hercules Inc., Wilmington, Del.

NSR—COBOND 1000 (polyaldehyde wet strength resin; National Starch & Chemical)

P631—PAREZ 631 NC (polyacrylamide wet strength additive; Cytec Industries)

P750A—PAREZ 750A (polyacrylamide wet strength resin; Cytec Industries)

Handsheets are made essentially according to TAPPI standard T205 with the following modifications:

(1) tap water, adjusted to a desired pH, generally between 4.0 and 4.5, with $H_2SO_4$ and/or NaOH is used for dispersion of the papermaking fibers, for dispersion or solution of the wet strength resins, and for dispersion or solution of other papermaking additives. After combining the fiber slurry with wet strength additive, the pH range of 4.0–4.5 is verified, and the same procedure is followed after addition of each subsequent papermaking additive.

(2) the sheet is formed on a polyester wire and dewatered by suction instead of pressing;

(3) the embryonic web is transferred by vacuum to a polyester papermaking fabric;

(4) the sheet is then dried by steam on a rotary drum direr.

An aqueous paper making furnish having a consistency of<1% is prepared using the paper making fibers. A<1% aqueous solution of polyaldehyde wet strength resin is added to the furnish and mixed vigorously for one hour. A<1% aqueous solution of neutral guar gum is then added to the furnish and vigorously mixed for one hour. When charged guar gums are used they are added to the papermaking furnish after one hour of mixing with the polyaldehyde wet strength resin. Where both an anionic guar gum and a cationic guar gum are added, the anionic guar gum is added first followed by cationic guar gum after one hour of mixing. The amount of the polyaldehyde wet strength resin and guar gum added to the paper are described in each of the Tables below.

Handsheets are formed by dilution of the fibers and additives in a deckle box (also known as handsheet mold), e.g. 1.6 gm fiber in 2.5 liters water, diluted in 45 liters water. The water is drained, the wet web vacuumed and the handsheet is dried on a drum drier at 240° F.

The paper products of these examples have initial total wet tensile strengths (ITWT), 30 minute total wet tensile strengths (30 MTWT), and total dry tensile strengths (TDT) as shown in the Tables below.

Table I shows tensile properties of handsheets formed with COBOND 1000 and neutral gaur: gum, anionic guar gum and/or cationic guar gum, as applied to furnishes of eucalyptus hardwood kraft fiber and northern softwood kraft fiber. The fibers are unrefined, and the paper is not creped.

TABLE I

| Sample Description | Furnish % EHK/NSK | Basis Wt. (lb/3000 ft$^2$) | ITWT (gm/in) | 30 MTWT (gm/in) | TDT (gm/in) |
|---|---|---|---|---|---|
| 4 lb/ton NSR | 80/20 | 18.0 | 191 | 35 | — |
| 4 lb/ton NSR; 60 lb/ton NGG | 80/20 | 18.0 | 274 | — | — |
| 4 lb/ton NSR | 60/40 | 18.0 | 202 | — | — |
| 2 lb/ton NSR; 20 lb/ton NGG | 60/40 | 18.0 | 190 | — | 1829 |
| 4 lb/ton NSR;20 lb/ton NGG | 60/40 | 18.0 | 257 | — | 1810 |
| 4 lb/ton NSR;40 lb/ton NGG | 60/40 | 18.0 | 281 | — | 2123 |
| 4 lb/ton NSR; 60 lb/ton NGG | 60/40 | 18.0 | 311 | 66 | — |
| 4 lb/ton NSR; 40 lb/ton AGG | 60/40 | 18.0 | 221 | — | — |
| 4 lb/ton NSR; 20 lb/ton AGG; 20 lb/ton CGG | 60/40 | 18.0 | 306 | — | 2147 |

Table I shows that a significant increase in initial total wet tensile is provided by addition of neutral guar gum to the COBOND 1000 fiber furnish, relative to that obtained with only COBOND 1000 and fiber or gum and fiber. When anionic guar gum and cationic guar gum are added sequentially to the COBOND 1000 fiber furnish, an even greater increase in initial total wet tensile is realized.

Other polyaldehyde additives when combined with guar gums also demonstrate a significant increase in initial total wet tensile relative to that obtained with only the polyaldehyde or gum and fiber. For example, Table II shows tensile properties of handsheets prepared with the temporary wet strength resin, P631 NC alone and in combination with neutral guar gum.

TABLE II

| Sample Description | Furnish % EHK/NSK | Basis Wt. (lb/3000 ft$^2$) | ITWT (gm/in) | 30 MTWT (gm/in) | TDT (gm/in) |
|---|---|---|---|---|---|
| 5 lb/ton P631 | 80/20 | 18.5 | 233 | 47 | 949 |
| 10 lb/ton P631 | " | " | 324 | 94 | 1039 |
| 5 lb/ton P631 10 lb/ton NGG | " | " | 305 | 76 | 1491 |
| 5 lb/ton P631 20 lb/ton NGG | " | " | 355 | 108 | 1706 |
| 5 lb/ton P631 40 lb/ton NGG | " | " | 422 | 148 | 1503 |
| 10 lb/ton P631 40 lb/ton NGG | " | " | 464 | 180 | 1583 |

dilution water is natural water which is acidified with sulfuric acid to an approximate pH of from about 4.5 to 5.5.

The sheets are formed on a polyester 84M forming wire. This wire is an "84M"; that is, the weave was 84×76 filaments per inch wire woven in a five-shed pattern to form an embryonic web. The embryonic paper web is transferred to a 36×32 five-shed fabric. These patterns and their use are described in Trokhan, U.S. Pat. No. 4,191,609, and Trokhan, U.S. Pat. No. 4,239,065, both of which are incorporated by reference herein. The embryonic paper sheet is first dried with hot air in a flow-through dryer to a moisture level of about 50% by weight of the sheet. Such a hot air dryer is well known to those skilled in the art. The final drying is accomplished on the surface of a Yankee dryer (to which the web has been adhered with polyvinyl alcohol). The paper is dried to approximately 3% moisture, and then creped from the Yankee with a doctor blade and reeled to provide an ultimate residual crepe of about 20%.

TABLE III

| Example | Fiber Mix | polyaldehyde/ polyhydroxyl polymers | Basis weight (lb/3000 ft$^2$) | ITWT (g/in) | 30 minute TWT (g/in) | TDT (g/in) |
|---|---|---|---|---|---|---|
| 1 (creped) | EHK/NSK (80/20) | P750A/NGG (20/80) | 18.5 | 144 | 30 | 823 |
| 2(creped) | EHK | P750A/NGG (20/80) | 21 | 128 | 34 | 747 |
| 3 (uncreped) | EHK/NSK (80/20) | P750A/NGG (20/80) | 18.5 | 382 | 65 | 2219 |
| 4 (uncreped) | EHK | P750A/NGG (20/80) | 21 | 386 | 54 | 2394 |
| 5 (uncreped) | EHK/CTMP (80/20) | P750A/NGG (20/80) | 18.5 | 348 | 73 | 1263 |

Table II shows that handsheets prepared using both P631 NC and neutral guar gum provide an initial total wet tensile that is significantly higher than a corresponding handsheet prepared using only P631 NC. However, the handsheets prepared with neutral guar gum have a 30 minute total wet tensile that would in general be unacceptably high for use in paper toilet tissue products. The total dry tensile achieved with PAREZ 613 NC and guar gum is less than that obtained with the COBOND 1000 and guar gum as displayed in Table I.

As further examples, Table III shows tensile properties for paper products prepared using P750A in combination with neutral guar gum (Examples 1–2: machine made, creped tissue paper; Examples 3–5: handsheets).

The creped tissue paper treated is made according to the teachings of Sanford and Sisson, U.S. Pat. No. 3,301,746, issued Jan. 31, 1967, and U.S. Pat. No. 3,994,771, Morgan and Rich, issued Nov. 30, 1976. The paper is treated with polyaldehyde and guar gum in accordance with the present invention.

The paper machine uses a fixed roof former type of headbox. The fiber furnish comprises the fibers shown in Table III (type and weight ratio) and is formed homogeneously. The polyaldehyde and guar gum are added prior to sheet formation as aqueous solutions from separate storage tanks. The P750A aqueous solution (10 lb P750A active/ton of paper making fiber) is added prior to the aqueous solution of guar gum (40 lb guar gum active/ton of paper making fiber). The same applications of P750A and guar gum are used in handsheet preparation, the P750A first followed by the guar gum. For paper machine production, the headbox In uncreped handsheets (examples 3–5) the P750A/NGG combination produces exceptional levels of initial total wet tensile, and excellent 30 minute total wet tensile decay. These high wet strengths are present for handsheets prepared with and without softwood fibers. In handsheets with only kraft softwood or hardwood fibers, the total dry tensile is very high. Machine creping provides a large reduction in initial and 30 minute total wet tensile, as well as in dry tensile, relative to handsheets. In addition, an all kraft furnish provides a total dry tensile that is almost twice that of a corresponding handsheet made using the mixture of kraft and mechanical pulp fibers.

Machine made, creped paper has an initial total wet tensile strength and total dry tensile strength that is significantly lower than corresponding handsheets, and a 30 minute total wet tensile that is preferred for flushable paper products.

Thus, for a given level of polyaldehyde in a given system, PAREZ 631 NC tends to provide a more permanent wet strength than PAREZ 750A (i.e., the wet strength decay rate of the PAREZ 631 NC product is significantly lower than that of the PAREZ 750A product) such that the PAREZ 750A is preferred for flushable paper products. The rate of wet tensile decay tends to decrease with an increase in the level of application of the polyaldehydes.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A paper product having a 30 minute total wet tensile strength of not more than about 40 g/inch, the paper product comprising:

(a) cellulosic fibers; and (b) a binder, said binder comprising (i) a polyaldehyde polymer having free aldehyde groups and (ii) a water-soluble polysaccharide having hydroxyl groups comprising cis-hydroxyl groups, said aldehyde groups of said polyaldehyde being reacted with said cellulosic fibers and with said hydroxyl groups of said polysaccharide to form chemical bonds joining said fibers.

2. The product of claim 1 wherein said polysaccharide is derived from one or more sugars selected from the group consisting of mannose, galactose, allose, altrose, gulose, talose, ribose, and lyxose.

3. The product of claim 2 wherein said polysaccharide is derived from mannose and/or galactose.

4. The product of claim 1 wherein said polysaccharide is selected from the group consisting of guar gum, locust bean gum, cationic guar gum, cationic locust bean gum, anionic guar gum, and anionic locust bean gum, or combinations thereof.

5. The product of claim 1 wherein said polysaccharide is a neutral polysaccharide or a charge balanced mixture of polysaccharides.

6. The product of claim 1 wherein said polyaldehyde is selected from the group consisting of aldehyde functionalized starches, aldehyde functionalized polyacrylamides, and acrolein polymers.

7. The product of claim 1 wherein said polyaldehyde is a cationic polyaldehyde.

8. The product of claim 7 wherein said polyaldehyde is a cationic, aldehyde functionalized starch.

9. The product of claim 7 wherein said polyaldehyde is a cationic, aldehyde functionalized polyacrylamide.

10. The product of claim 1 wherein the product comprises from about 0.01 to about 5 weight % of said polyaldehyde and from about 0.01 to about 5 weight % of said polysaccharide, based on the weight of said cellulosic fibers.

11. The product of claim 10 wherein the product comprises from about 0.01 to about 0.5 weight % of said polyaldehyde and from about 0.01 to about 3 weight % of said polysaccharide, based on the weight of said cellulosic fibers.

12. A method of making a paper product having a 30 minute total wet tensile strength of not more than about 40 g/inch, the method comprising the steps of:

(a) providing a slurry comprising water, papermaking fibers, a polyaldehyde comprising free aldehyde groups, and a water soluble polysaccharide having hydroxyl groups comprising cis-hydroxyl groups; said slurry having a pH of 7 or less;

(b) depositing said slurry onto a foraminous substrate;

(c) draining the water from said fibers;

(d) drying the paper made from said fibers; and (e) reacting said aldehyde groups of said polyaldehyde with said cellulosic fibers and with said hydroxyl groups of said polysaccharide to form chemical bonds joining said fibers when said fibers are dry.

13. The method of claim 12 wherein said pH is in the range of from about 2 to about 7.

14. The method of claim 12 wherein said step (a) of forming a slurry comprises:

(i) forming a first aqueous mixture comprising said cellulosic fibers, a second aqueous mixture comprising said polyaldehyde substantially dissolved in an aqueous medium, and a third aqueous mixture comprising said polysaccharide substantially dissolved in an aqueous medium;

(ii) combining said first, second, and third aqueous mixtures to form a reactant mixture; and (iii) adjusting the pH of said reactant mixture to a pH of about 7 or less.

15. The method of claim 12 wherein said step (a) of forming a slurry comprises:

(i) forming a first aqueous mixture comprising said cellulosic fibers, a second aqueous mixture comprising said polyaldehyde substantially dissolved in an aqueous medium, and a third aqueous mixture comprising said polysaccharide substantially dissolved in an aqueous medium;

(ii) combining said first and second aqueous mixtures to form a first reactant mixture;

(iii) adjusting the pH of said first reactant mixture to a pH of about 7 or less;

(iv) combining said first reactant mixture with said third aqueous mixture to form a second reactant mixture; and (v) adjusting the pH of said second reactant mixture to a pH of about 7 or less.

* * * * *

UNITED STATES PATENT AND TRADEMARK OFFICE
CERTIFICATE OF CORRECTION

PATENT NO. : 5,690,790

DATED : November 25, 1997

INVENTOR(S) : Michael Martyn Headlam et al.

It is certified that error appears in the above-identified patent and that said Letters Patent is hereby corrected as shown below:

Column 1, line 44, "tower" should read -- towel --.

Column 5, line 10, "galaetose" should read -- galactose --.

Column 5, line 29, "polysaccarides" should read -- polysaccharides --.

Column 7, line 60, "port/on" should read -- portion--.

Column 10, line 33, "gaur:" should read -- guar --.

Signed and Sealed this

Sixteenth Day of November, 1999

*Attest:*

Q. TODD DICKINSON

*Attesting Officer*

*Acting Commissioner of Patents and Trademarks*